US007543783B2

(12) United States Patent
Ollard et al.

(10) Patent No.: US 7,543,783 B2
(45) Date of Patent: Jun. 9, 2009

(54) DISPLAY DEVICE FOR A BOTTLE

(75) Inventors: Gaël Ollard, Clearwater, FL (US); Christophe Guichard, La Garenne Colombes (FR)

(73) Assignee: Société Jas Hennessey Et Compagnie, Cognac (FR)

( * ) Notice: Subject to any disclaimer, the term of this patent is extended or adjusted under 35 U.S.C. 154(b) by 357 days.

(21) Appl. No.: 11/174,293

(22) Filed: Jul. 1, 2005

(65) Prior Publication Data

US 2007/0018060 A1 Jan. 25, 2007

(51) Int. Cl.
*A47G 23/02* (2006.01)

(52) U.S. Cl. ..... 248/154; 215/395; 206/477; 248/316.8

(58) Field of Classification Search ..... 248/551, 248/553, 346.06, 510, 154, 187.1, 312, 313, 248/316.8; 215/395, 400; 220/4.22, 730, 220/737, 890; 206/477; 232/41 R, 41 A, 232/41 E See application file for complete search history.

(56) References Cited

U.S. PATENT DOCUMENTS 339,396 A * 4/1886 Fisher ..... 86/44
637,622 A * 11/1899 Krick ..... 248/170
781,713 A * 2/1905 Cahill ..... 248/154
872,052 A * 11/1907 Chittenden ..... 362/375
1,139,780 A * 5/1915 Rendelman ..... 232/42
1,159,491 A * 11/1915 Graham ..... 220/737
1,221,354 A * 4/1917 Mitchell ..... 70/163
1,408,184 A * 2/1922 Farlow ..... 81/3.32
1,951,749 A * 3/1934 Campagna ..... 248/154
1,989,436 A * 1/1935 Weigand ..... 248/312
2,698,597 A * 1/1955 Buck ..... 118/503
3,168,272 A * 2/1965 Swinyar ..... 248/139
3,733,041 A 5/1973 Clavera ..... 248/154
4,684,016 A * 8/1987 Simkins ..... 206/754
4,693,440 A * 9/1987 Lalonde ..... 248/154
5,033,709 A * 7/1991 Yuen ..... 248/313
5,398,898 A * 3/1995 Bever ..... 248/154
5,560,578 A * 10/1996 Schenken et al. ..... 248/313
6,732,880 B1 * 5/2004 Nash, Sr. ..... 220/495.06
6,755,382 B1 * 6/2004 Melnick ..... 248/316.8

FOREIGN PATENT DOCUMENTS

GB 2 403 715 A 1/2005

* cited by examiner

*Primary Examiner*—J. Allen Shriver, II
*Assistant Examiner*—Bradley H Duckworth
(74) *Attorney, Agent, or Firm*—Occhiuti Rohlicek & Tsao LLP

(57) ABSTRACT

A display device for a bottle includes a pedestal, and a display panel for holding and retaining the bottle. The display panel is formed of two transparent shells extending upwardly from the pedestal, each shell being provided with a recess and being moveable, with respect to the pedestal, between a closed position in which the shells are adjacent and in which the recesses together from an internal cavity the shape of which is complementary with the shape of the bottle, and an open position in which the shells are spaced from each other.

15 Claims, 5 Drawing Sheets

FIG. 1
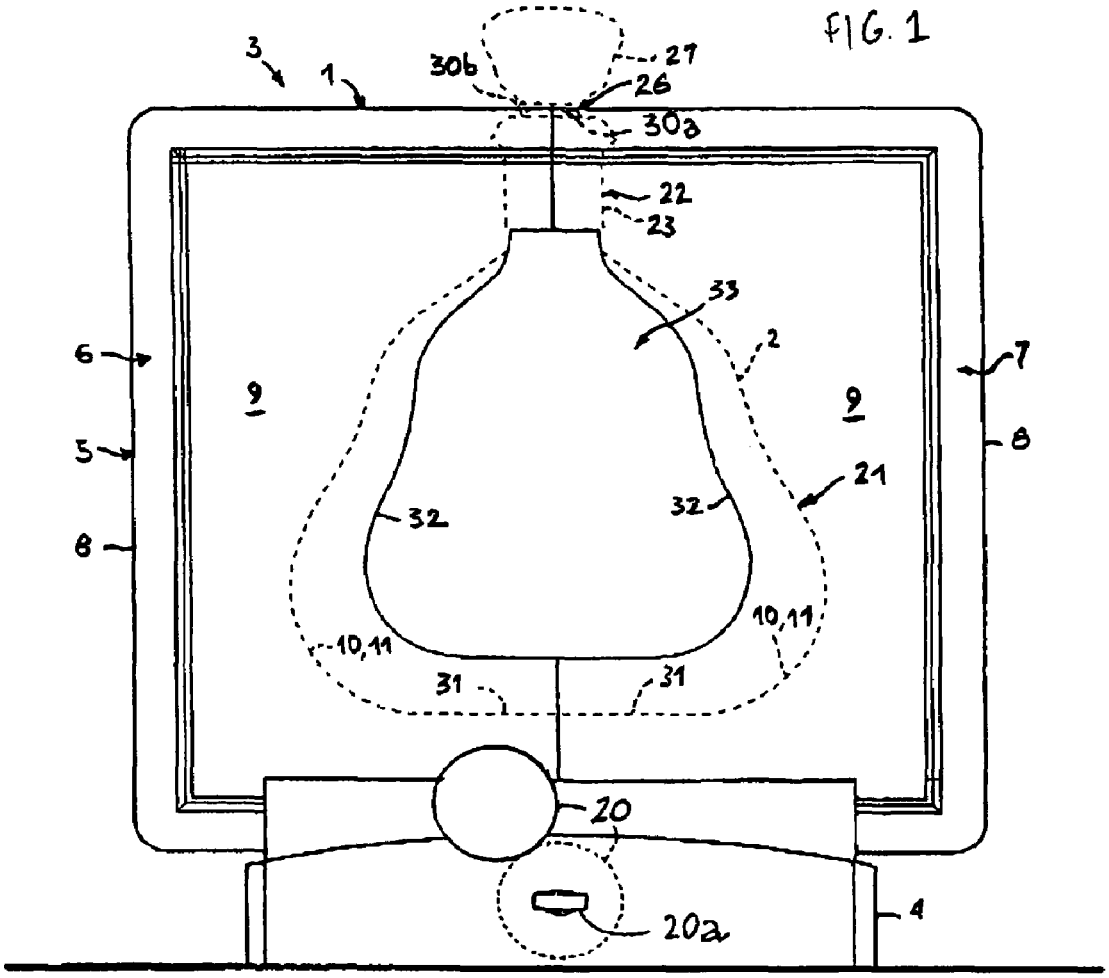
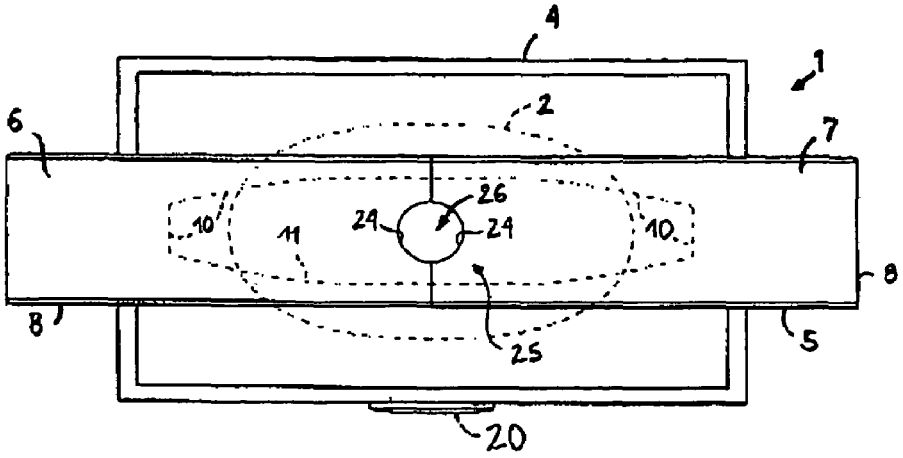
FIG. 3

VI

FIG. 7
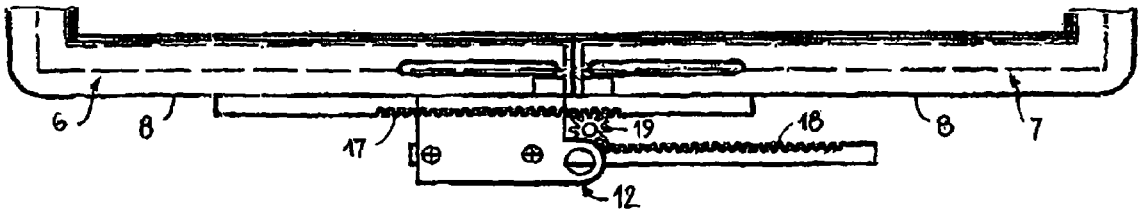
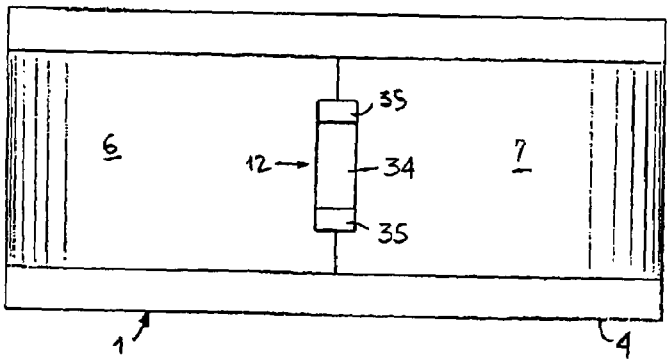
FIG. 9

DISPLAY DEVICE FOR A BOTTLE

FIELD OF THE INVENTION

The invention relates to a display device for a bottle, e.g. a bottle of precious alcohol such as an old brandy, and to a package including such a display device together with the corresponding bottle.

BACKGROUND OF THE INVENTION

Various bottle displays or bottle supports are known. For example, U.S. Pat. No. 3,733,041 discloses a display device for a bottle of wine simulating an antique wine press. It includes a base with means to center the bottle and a structure carrying a clamp that holds the bottle firmly on the base. A collar fits the neck of the bottle to secure the bottle transversely relative to the structure.

There is still a need for display devices designed for showing to advantage the peculiar shape of decorative objects, such as jewel-like bottles.

There is also a need for display devices, in particular for bottles, the precious alcohol of which needs to be preserved from being hastily consumed.

SUMMARY OF THE INVENTION

The invention provides a display device for a bottle, comprising:

a pedestal;

a display panel for holding and retaining the bottle, said display panel being formed of two transparent shells extending upwardly from the pedestal, each shell being provided with a recess and being moveable, with respect to the pedestal, between a closed position in which the shells are adjacent and in which the recesses together form an internal cavity the shape of which is complementary with the shape of the bottle, and an open position in which the shells are spaced from each other.

The bottle is thereby shown to advantage through the transparent shells on top of the pedestal, whereas actuation of the shells to the open position gives manual access to the bottle.

According to one preferred embodiment, the display device is further provided with a lock having a locked position in which it locks the shells in their closed position, thereby preventing the bottle from being removed from the cavity, and an unlocked position in which the lock allows said shells to move to their open position, thereby allowing removal of the bottle from the cavity.

Accordingly, it is necessary to unlock and open the display panel in order to remove the bottle therefrom and pour the beverage.

The above and other objects and advantages of the invention will become apparent from the detailed description of preferred embodiments, considered in conjunction with the accompanying drawings.

BRIEF DESCRIPTION OF THE DRAWINGS

FIG. 1 is an elevation front view of a package including a display device according to a first embodiment of the invention, together with a bottle (in dashed lines) received therein, the display device being shown in a closed configuration;

FIG. 3 is a top plan view of the display device of FIGS. 1 and 2;

FIG. 7 is a partial view similar to FIG. 4, showing further details of the lock of the display device;

FIG. 9 is a top view of the package of FIG. 8; and

DESCRIPTION OF A PREFERRED EMBODIMENT

Figure 4:
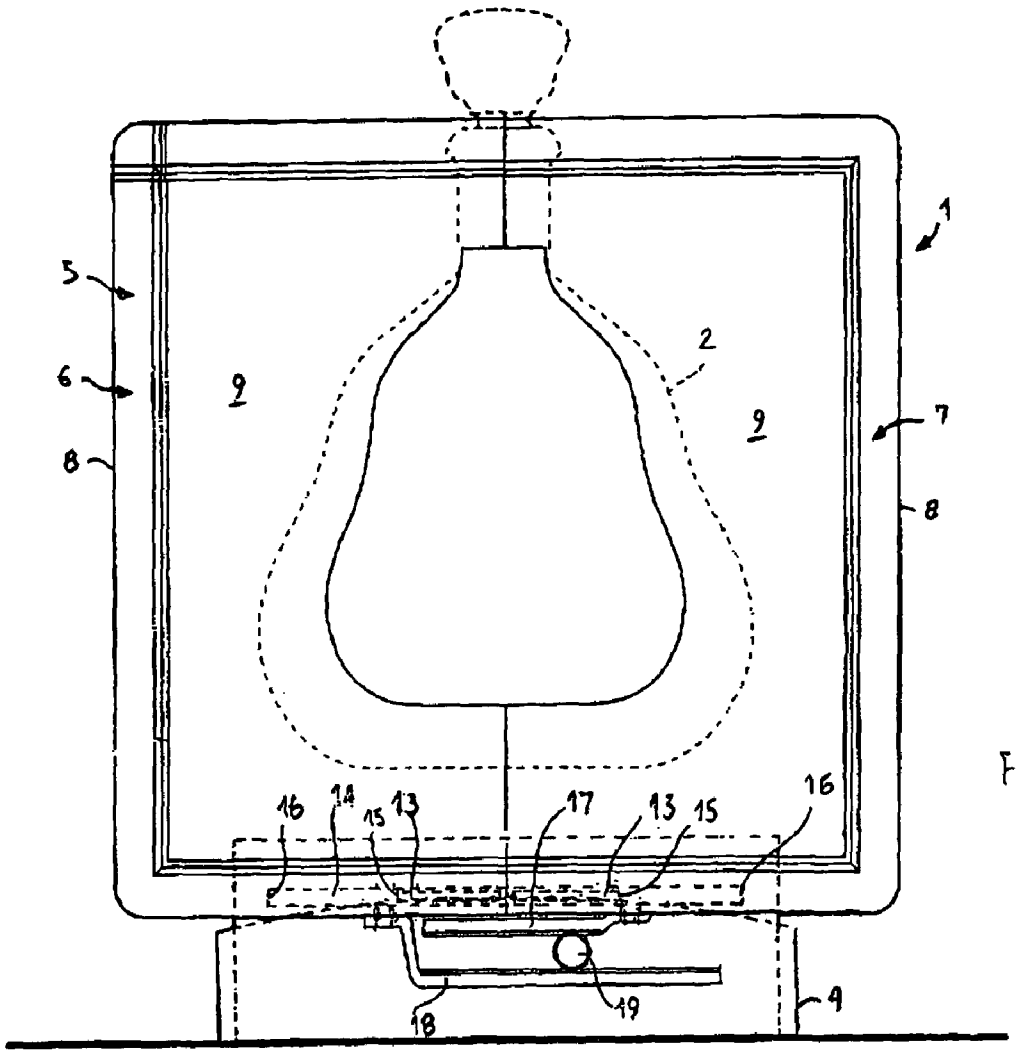
FIG. 4 is an elevation front view of the display device of FIG. 1, giving further visual access to the inside of the pedestal, the display being shown in a closed configuration.

Referring to FIG. 1, there is shown a display device 1 for a jewel-like bottle 2 it is desired to show to advantage. The bottle 2 may contain a beverage, and more particularly a precious alcohol, e.g. an old brandy, which it may be desired to preserve from hastily consumed. The display device 1 and the bottle 2 together form a package 3.

The display device 1 comprises a pedestal 4 to be put on a shelf or any other suitable furniture, and a rectangular display panel 5 for holding and retaining the bottle 2.

The display device 1 has two configurations, i.e. a closed configuration, in which removal of the bottle 2 from the display panel 5 is prevented, and an open configuration, in which access to and removal of the bottle 2 from the display panel 5 is allowed.

The display panel 5 is formed of two transparent symmetrical shells 6, 7 extending upwardly from the pedestal 4, each shell comprising a metallic frame 8 and a transparent core 9 mounted thereon. The core 9 is preferably made of Plexiglas, polycarbonate, or the like, and is provided with a recess 10.

Figure 5:
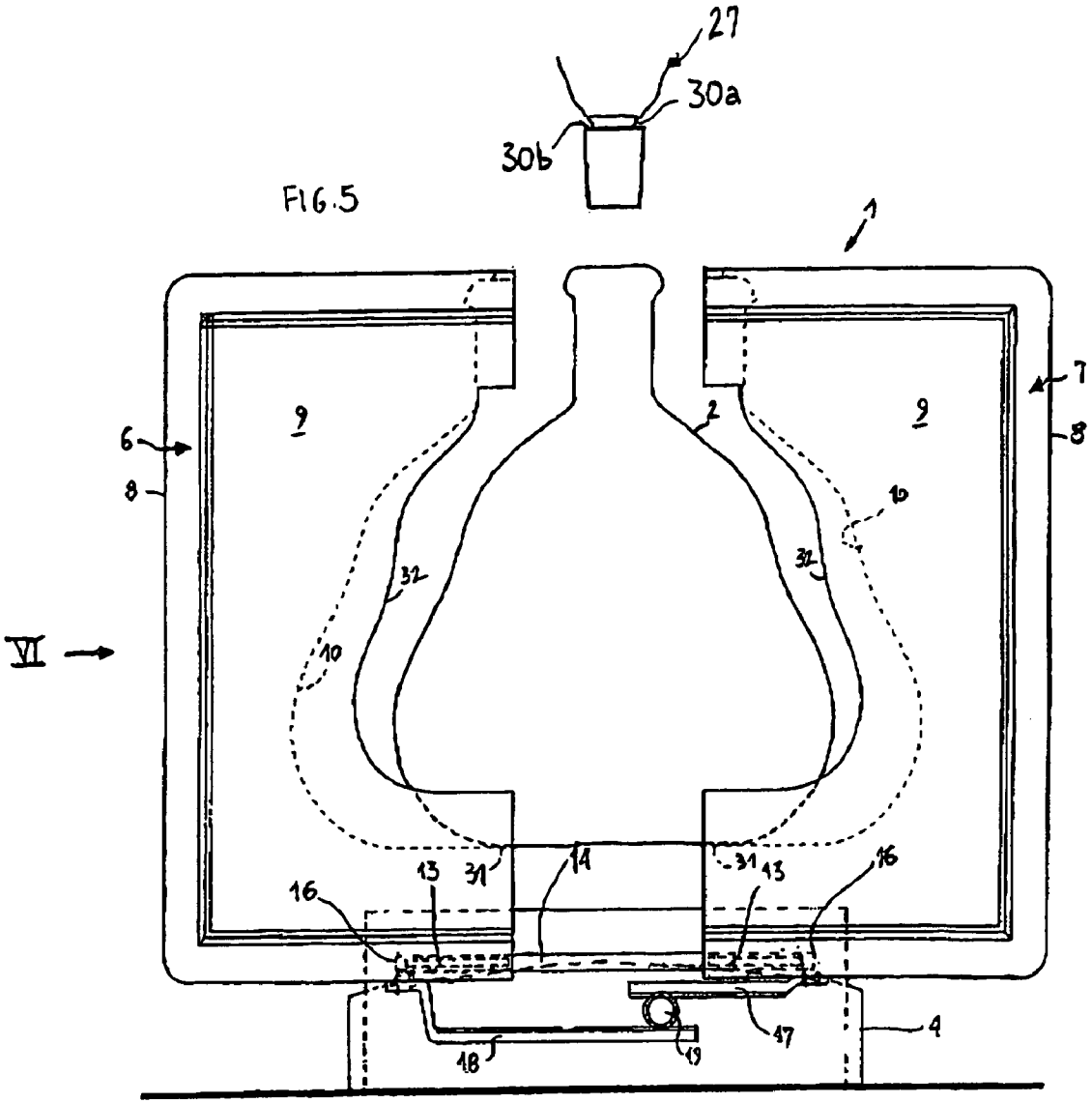
FIG. 5 is a view similar to FIG. 4, where the display is shown in an open configuration.

Each shell 6, 7 is moveable, with respect to the pedestal 4, between:

a closed position, corresponding to the closed configuration of the display device 1, in which the shells 6, 7 are adjacent and in which the recesses 10 together form an internal cavity 11, the shape of which is complementary with the shape of the bottle 2 (FIGS. 1, 4), and an open position, corresponding to the open configuration of the display device 1, in which the shells 6, 7 are spaced from each other (FIG. 5).

In one preferred embodiment, the display device 1 also comprises a lock 12 having a locked position in which it locks the shells 6, 7 in their closed position, and an unlocked position in which the shells 6, 7 are free to move to their open position.

As depicted on FIGS. 4 and 5, in a first embodiment the shells 6, 7 may be slidingly mounted with respect to the pedestal 4. More precisely, each shell 6, 7 may be provided with a pair of straight ribs 13 which are slidingly received in corresponding grooves 14 formed in the pedestal. For example, the ribs 13 have end surfaces 15 which, in the open position, come into abutment against stop surfaces 16 formed at ends of the corresponding grooves 14, thereby limiting the stroke of the shells 6, 7 in the open position.

In a preferred embodiment depicted on FIGS. 4, 5 and 7, each shell 6, 7 may be mounted, for example by means of the frame 8, on a rack 17, 18, received in the pedestal 4, and engaging a common gear 19 pivotally mounted with respect to the pedestal 4. For example, an upper rack 17 is located and moves above the gear 19, whereas a lower one 18 is located and moves under the gear 19, symmetrically with respect of the upper rack 17. Accordingly, the shells 6, 7 are forced to move together with each other, from one position to the other. In other words, moving one shell 6, in one direction automatically moves the other one 7 in the opposite direction. This provides soft, safe and simple closure/aperture of the display panel 1.

The lock 12, which is mounted on the pedestal 4, can be put in either position by means of a key (not shown) after having displaced to an uncovering position (in plain line on FIG. 1) a hinged cap 20 which, in a rest position (in dashed line on FIG. 1), covers and hides a keyhole 20*a*. In the locked position, the lock 12 blocks one of the racks (e.g. the lower one 18) in the closed position, thereby preventing the shells from 6, 7 being put in the open position.

For example, the recesses 10 are such shaped that the cavity 11 has an enlarged central portion 21, and a narrower upper portion 22 corresponding to a neck 23 of the bottle 2.

Figure 2:
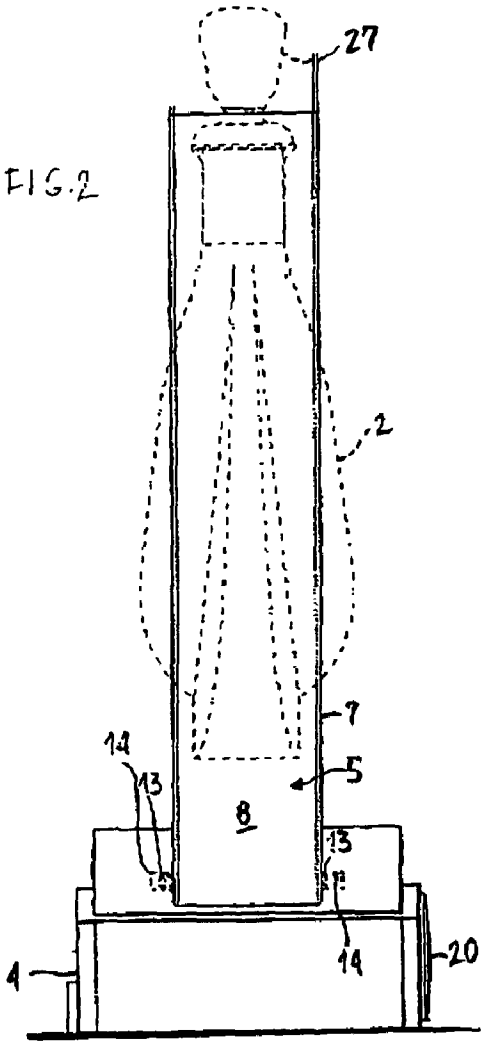
FIG. 2 is an elevation side view of the package of FIG. 1.
Figure 6:
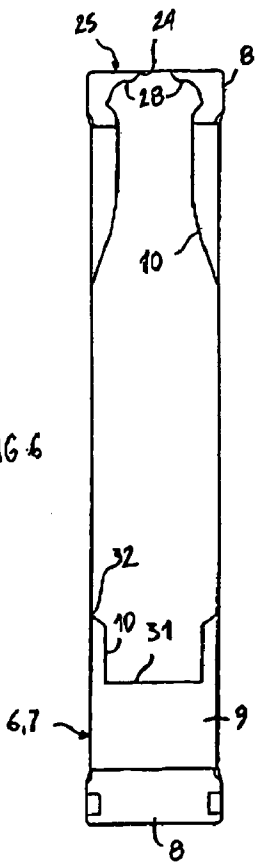
FIG. 6 is an elevation side view showing a singular shell of the display device of the preceding figures, viewed in direction VI of FIG. 5.

As depicted on FIGS. 3 and 6, each recess 10 forms a semi-circular cutout 24 in a top face 25 of the corresponding shell 6, 7, whereby the cutouts 24 together form, in the closed position of the shells, a circular orifice 26 through which a closure cap 27 of the bottle 2 emerges from the display panel 5 (FIGS. 1, 2). More precisely, as depicted on FIG. 1, the closure cap 27 may be provided with a neck 30*a* in the form of an annular groove extending through the orifice 26.

In addition, in a preferred embodiment depicted on FIG. 6, each recess 10 forms, in the vicinity of the cutout 24, a semi-circular shoulder surface 28, oriented downwards. In the closed position of the shells 6, 7, the shoulder surfaces 28 together form an annular stop surface 29 cooperating with a corresponding shoulder surface 30*b* formed below the neck 30*a* on the closure cap 27, removal of which is thereby prevented.

Accordingly, in the closed configuration of the display device 1, in which the shells 6, 7 are locked in their closed position, the bottle 2 is prevented from being removed from the cavity 11, whereas the cap 27 is prevented from being separated from the bottle 2. Unlocking the display device 1 is therefore necessary in order do access the bottle and pour the beverage.

In the open configuration of the display device 1, which is achieved after unlocking and putting the shells 6, 7 in their open position, removal of the bottle 2 from the cavity 11 is thereby allowed.

As depicted on FIG. 5, each recess 10 has a flat bottom bearing surface 31, so that in the open position the bottle 2 is held vertically and ready for easy manual grasping.

In one preferred embodiment, the cores 9 of the shells 6, 7 have cutouts 32 together forming, in the closed position, an aperture 33 allowing the bottle 2 to be touched even in the closed position. The cutouts 32 are shaped so that the aperture 33 corresponds to the shape of the internal cavity 11 at a plane corresponding to the surface of the core 9. As discussed above, the shape of the internal cavity 11 corresponds to the shape of the bottle. On the other hand, the cutouts 32 facilitate manual access to the bottle 2 in the open configuration, so that it is not necessary to turn the bottle 2 while removing it from the display device 1. Moreover, the bottle 2 may be thicker than the display panel 5, so that it emerges through the aperture 33 in the closed configuration of the display device 1 (FIG. 2).

Figure 8:
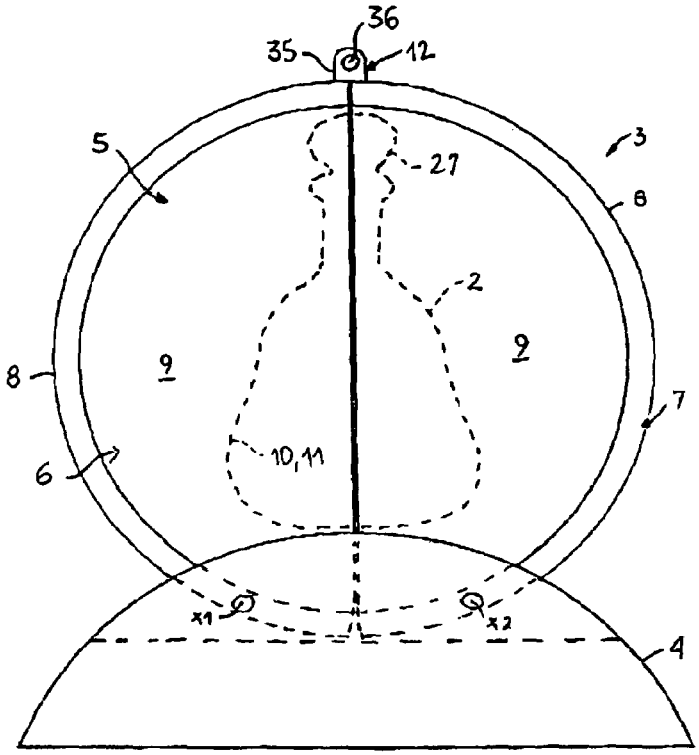
FIG. 8 is an elevation front view of a package including a display device according to a second embodiment of the invention, together with a bottle received therein, the display being shown in a closed configuration.
Figure 10:
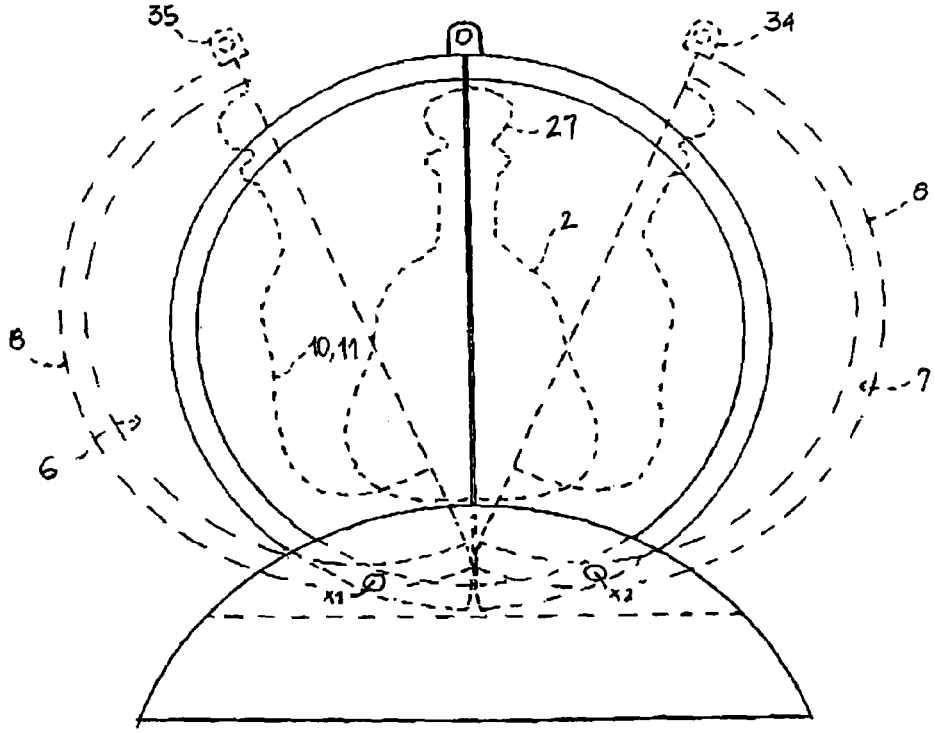
FIG. 10 is an elevation front view of the package of FIG. 8 and 9, in which the display device is shown in an open configuration in dashed lines.

In a second embodiment, depicted on FIGS. 8, 9 and 10, the display device 1 differs from the preceding one through the following features:

the display panel 5 has a circular shape;

the shells 6, 7 are pivotally mounted with respect to the pedestal 4 around axis X1, X2;

the shells 6, 7 are thicker and higher than the bottle 2 and have no cutouts, whereby, in the closed configuration of the display device 1 (FIG. 8), the bottle 2, including its cap 27, is totally enclosed in the display panel 5 and does not emerge from it;

Of course, the shells 6, 7 will open at a sufficient angular aperture in the open position so as to permit easy removal of the bottle 2 (FIG. 10).

As depicted on FIG. 9, the lock 12 may consist of a simple hasp, comprising a barrel 34 formed on a top edge of a first shell 6, and a complementary cope 35 formed on the second shell 7, both provided with coaxial bores 36, whereby introduction of a padlock pin (not shown) in the bores 36 locks the display device 1 in its closed configuration.

The invention claimed is:

1. Display device for a bottle, comprising:

a pedestal, and a display panel for holding and retaining a bottle, said display panel being formed of two transparent shells extending upwardly from the pedestal, each shell comprising a frame and a core mounted thereon, the core of each shell being rigid and provided with a concave, arcuate recess and each shell being moveable with respect to the pedestal, between a closed position in which the shells are partly adjacent and in which the recesses together form an internal cavity the shape of which is partly complementary with the shape of a bottle, and an open position in which the shells are spaced from each other, the cores further have lateral faces provided with lateral cutouts together forming, in the closed position, a lateral aperture allowing a bottle held in the recess to be touched even in the closed position, the internal cavity opening out into said lateral aperture.

2. Display device according to claim 1, further comprising a lock having a locked position in which the shells are locked in their closed position, thereby preventing the bottle from being removed from the cavity, and an unlocked position in which said shells are allowed to move to their open position, thereby allowing removal of the bottle from the cavity.

3. Display device according to claim 1, wherein the shells are slidingly mounted with respect to the pedestal.

4. Display device according to claim 1, wherein the shells are pivotally mounted with respect to the pedestal.

5. Display device according to claim 1, wherein each shell comprises a rack engaging a common gear, whereby the shells are forced to move together with each other, from one position to the other.

6. Display device according to claim 5, further comprising a lock having a locked position in which the shells are locked in their closed position and the racks are blocked in the closed position, thereby preventing the bottle from being removed from the cavity, and an unlocked position in which said shells are allowed to move to their open position, thereby allowing removal of the bottle from the cavity.

7. Display device according to claim 6, wherein the racks are received in the pedestal, whereas the lock is mounted on the pedestal.

8. Display device according to claim 1, wherein each recess forms a top cutout in a top face of the corresponding shell, whereby the top cutouts together form, in the closed position of the shells, an orifice through which a closure cap of a bottle can emerge from the display panel.

9. Display device according to claim 8, wherein each recess forms, in the vicinity of the cutout, a shoulder surface, whereby, in the closed position of the shells, the shoulder surfaces together form an annular stop surface for retaining the closure cap of the bottle.

10. Package comprising a bottle, and a display device including:

a pedestal, and a display panel for holding and retaining the bottle, said display panel being formed of two transparent shells extending upwardly from the pedestal, each shell comprising a frame and a core mounted thereon, the core of each shell being rigid and provided with a concave, arcuate recess and each shell being moveable, with respect to the pedestal, between a closed position in which the shells are partly adjacent and in which the recesses together form an internal cavity the shape of which is partly complementary with the shape of the bottle, and an open position in which the shells are spaced from each other;

the cores further have lateral faces provided with lateral cutouts together forming, in the closed position, a lateral aperture allowing a bottle held in the recess to be touched even in the closed position, the internal cavity opening out into said lateral aperture.

11. Display device according to claim 1, wherein the shape of the lateral aperture corresponds to the shape of the internal cavity at the lateral face.

12. Display device according to claim 1, wherein when viewed in a direction facing the lateral face, a dimension of an outline of the lateral aperture is smaller than that of a corresponding dimension of the internal cavity.

13. Display device according to claim 12, wherein when viewed in a direction facing the lateral face, the difference between the dimension of the outline of the lateral aperture and that of the corresponding dimension of internal cavity is sufficient to retain a bottle in the recess in closed position.

14. Package according to claim 10, wherein the bottle is thicker than the display panel, so that in the closed position it emerges through the aperture.

15. Package according to claim 10, wherein the lateral aperture has the same shape as that of the bottle.

* * * * *